US008105740B2

(12) United States Patent
Wu

(10) Patent No.: US 8,105,740 B2
(45) Date of Patent: Jan. 31, 2012

(54) FATTY ESTER CONTAINING PHOTOCONDUCTORS

(75) Inventor: Jin Wu, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 387 days.

(21) Appl. No.: 12/431,834

(22) Filed: Apr. 29, 2009

(65) Prior Publication Data

US 2010/0279216 A1 Nov. 4, 2010

(51) Int. Cl.
*G03G 5/047* (2006.01)

(52) U.S. Cl. ..... 430/59.1; 430/58.8; 430/59.4; 430/59.5

(58) Field of Classification Search ..... 430/58.8, 430/59.1, 59.4, 59.5
See application file for complete search history.

(56) References Cited

U.S. PATENT DOCUMENTS

| | | | | |
|---|---|---|---|---|
| 4,265,990 | A | 5/1981 | Stolka et al. | |
| 4,555,463 | A | 11/1985 | Hor et al. | |
| 4,587,189 | A | 5/1986 | Hor et al. | |
| 5,473,064 | A | 12/1995 | Mayo et al. | |
| 5,482,811 | A | 1/1996 | Keoshkerian et al. | |
| 5,521,306 | A | 5/1996 | Burt et al. | |
| 6,913,863 | B2 | 7/2005 | Wu et al. | |
| 2006/0105254 | A1 | 5/2006 | Wu et al. | |
| 2007/0098994 | A1 * | 5/2007 | Wu et al. | 428/411.1 |
| 2007/0298341 | A1 | 12/2007 | Wu et al. | |
| 2007/0298342 | A1 * | 12/2007 | Wu et al. | 430/58.75 |

OTHER PUBLICATIONS

Codex Alimentarius vol. 8: Codex Standard for Named Vegetable Oils, published Jan. 1991. Obtained from: www.codexalimentarius.net/download/standards/336/CXS_210e.pdf.*

Jin Wu, U.S. Appl. No. 12/059,573 on Oxadiazole Containing Photoconductors, filed Mar. 31, 2008.

* cited by examiner

*Primary Examiner* — Peter Vajda

(74) *Attorney, Agent, or Firm* — Oliff & Berridge, PLC

(57) ABSTRACT

A photoconductor that includes, for example, a supporting substrate, a photogenerating layer, and a charge transport layer, and wherein the photogenerating layer contains a vulcanized fatty ester.

22 Claims, No Drawings

FATTY ESTER CONTAINING PHOTOCONDUCTORS

CROSS REFERENCE TO RELATED APPLICATIONS

Copending U.S. application Ser. No. 12/059,573, filed Mar. 31, 2008, entitled Oxadiazole Containing Photoconductors, the disclosure of which is totally incorporated herein by reference, illustrates a photoconductor comprising a supporting substrate, a photogenerating layer, and at least one charge transport layer wherein at least one of the charge transport layers is comprised of at least one charge transport component, and wherein at least one of the photogenerating layer, and the charge transport layer includes an oxadiazole.

In U.S. application Ser. No. 11/472,765, filed Jun. 22, 2006, U.S. Publication No. 20070298341, and U.S. Pat. No. 7,485,398, the disclosures of which are totally incorporated herein by reference, there are disclosed, for example, photoconductors comprising a photogenerating layer and a charge transport layer, and wherein the photogenerating layer contains a titanyl phthalocyanine prepared by dissolving a Type I titanyl phthalocyanine in a solution comprising a trihaloacetic acid and an alkylene halide; adding the mixture comprising the dissolved Type I titanyl phthalocyanine to a solution comprising an alcohol and an alkylene halide thereby precipitating a Type Y titanyl phthalocyanine; and treating the Type Y titanyl phthalocyanine with a monohalobenzene.

High photosensitivity titanyl phthalocyanines are illustrated in copending U.S. application Ser. No. 10/992,500, U.S. Publication No. 20060105254, the disclosure of which are totally incorporated herein by reference, which, for example, discloses a process for the preparation of a Type V titanyl phthalocyanine, comprising providing a Type I titanyl phthalocyanine; dissolving the Type I titanyl phthalocyanine in a solution comprising a trihaloacetic acid and an alkylene halide like methylene chloride; adding the resulting mixture comprising the dissolved Type I titanyl phthalocyanine to a solution comprising an alcohol and an alkylene halide thereby precipitating a Type Y titanyl phthalocyanine; and treating the Type Y titanyl phthalocyanine with monochlorobenzene to yield a Type V titanyl phthalocyanine.

A number of the components and amounts thereof of the above copending applications, such as the supporting substrates, resin binders, photogenerating layer components, such as hydroxygallium phthalocyanines, titanyl phthalocyanines, antioxidants, charge transport components, hole blocking layer components, adhesive layers, and the like, may be selected for the members of the present disclosure in embodiments thereof.

BACKGROUND

This disclosure is generally directed to members like xerographic imaging members; photoreceptors, photoconductors, and the like. More specifically, the present disclosure is directed to rigid, multilayered flexible, belt imaging members, or devices comprised of an optional supporting medium like a substrate, a fatty ester, and more specifically, a vulcanized fatty ester photogenerating layer, and a charge transport layer including a plurality of charge transport layers, such as a first charge transport layer and a second charge transport layer, an optional adhesive layer, an optional hole blocking or undercoat layer, and an optional overcoating layer. At least one in embodiments refers, for example, to one, to from 1 to about 10, to from 2 to about 7; to from 2 to about 4, to two, and the like. Moreover, the fatty ester can be added to the photogenerating layer instead of being dissolved in the photogenerating layer solution.

Yet more specifically, there is disclosed a photoconductor comprised of a supporting substrate, a vulcanized fatty ester, such as, for example, those esters as illustrated hereinafter, containing photogenerating layer, a charge transport layer, or charge transport layers, such as a first pass charge transport layer, a second pass charge transport layer to primarily permit excellent and minimal undesirable ghosting characteristics, reduced paper edge ghosting (PEG), as compared to a photoconductor that does not contain the fatty ester; excellent photoconductor photosensitivities, and an acceptable, and in embodiments a low $V_r$; and minimization or prevention of $V_r$ cycle up.

The photoconductors disclosed herein possess a number of advantages, such as in embodiments, the minimization of undesirable ghosting on developed images, such as xerographic images, including improved ghosting at various relative humidities; excellent cyclic and stable electrical properties; minimal charge deficient spots (CDS); compatibility with the photogenerating and charge transport resin binders; and acceptable lateral charge migration (LCM) characteristics, such as for example, excellent LCM resistance.

Ghosting refers, for example, to when a photoconductor is selectively exposed to positive charges in a number of xerographic print engines when some of the charges enter the photoconductor and manifest themselves as a latent image in the next printing cycle. This print defect can cause a change in the lightness of the half tones, and is commonly referred to as a "ghost" that is generated in the previous printing cycle. An example of a source of the positive charges is the stream of positive ions emitted from the transfer corotron. Since the paper sheets are situated between the transfer corotron and the photoconductor, the photoconductor is shielded from the positive ions from the paper sheets. In the areas between the paper sheets, the photoconductor is fully exposed, thus in this paper free zone the positive charges may enter the photoconductor. As a result, these charges cause a print defect or ghost in a half tone print if one switches to a larger paper format that covers the previous paper print free zone.

Excellent cyclic stability of the photoconductor refers, for example, to almost no or minimal change in a generated known photoinduced discharge curve (PIDC), especially no or minimal residual potential cycle up after a number of charge/discharge cycles of the photoconductor, for example about 100 kilocycles, or xerographic prints of, for example, from about 80 to about 100 kiloprints. Excellent color print stability refers, for example, to substantially no or minimal change in solid area density, especially in 60 percent halftone prints, and no or minimal random color variability from print to print after a number of xerographic prints, for example 50 kiloprints.

Also disclosed are methods of imaging and printing with the photoconductor devices illustrated herein. These methods generally involve the formation of an electrostatic latent image on the imaging member, followed by developing the image with a toner composition comprised, for example, of thermoplastic resin, colorant, such as pigment, charge additive, and surface additive, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same operation with the exception that exposure can be accomplished with a laser device or image bar. More specifically, flexible belts disclosed herein can be selected for the Xerox Corporation iGEN3® machines that generate with some versions over 100 copies per minute. Processes of imaging, especially xerographic imaging and printing, including digital, and/or color printing, are thus encompassed by the present disclosure. The imaging members are in embodiments sensitive in the wavelength region of, for example, from about 400 to about 900 nanometers, and in particular from about 650 to about 850 nanometers, thus diode lasers can be selected as the light source. Moreover, the imaging members of this disclosure are useful in high resolution color xerographic applications, particularly high speed color copying and printing processes.

REFERENCES

There is illustrated in U.S. Pat. No. 6,913,863, is a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

Layered photoresponsive imaging members have been described in numerous U.S. patents, such as U.S. Pat. No. 4,265,990, wherein there is illustrated an imaging member comprised of a photogenerating layer, and an aryl amine hole transport layer.

Further, in U.S. Pat. No. 4,555,463, there is illustrated a layered imaging member with a chloroindium phthalocyanine photogenerating layer. In U.S. Pat. No. 4,587,189, there is illustrated a layered imaging member with, for example, a perylene, pigment photogenerating component. Both of the aforementioned patents disclose an aryl amine component, such as N,N'-diphenyl-N,N'-bis(3-methylphenyl)-1,1'-biphenyl-4,4'-diamine dispersed in a polycarbonate binder as a hole transport layer. The above components, such as the photogenerating compounds and the aryl amine charge transport, can be selected for the imaging members of the present disclosure in embodiments thereof.

Illustrated in U.S. Pat. No. 5,521,306, the disclosure of which is totally incorporated herein by reference, is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811, the disclosure of which is totally incorporated herein by reference, is a process for the preparation of hydroxygallium phthalocyanine photogenerating pigments which comprises hydrolyzing a gallium phthalocyanine precursor pigment by dissolving the hydroxygallium phthalocyanine in a strong acid, and then reprecipitating the resulting dissolved pigment in basic aqueous media; removing any ionic species formed by washing with water; concentrating the resulting aqueous slurry comprised of water and hydroxygallium phthalocyanine to a wet cake; removing water from said slurry by azeotropic distillation with an organic solvent, and subjecting said resulting pigment slurry to mixing with the addition of a second solvent to cause the formation of said hydroxygallium phthalocyanine polymorphs.

Also, in U.S. Pat. No. 5,473,064, the disclosure of which is totally incorporated herein by reference, there is illustrated a process for the preparation of photogenerating pigments of hydroxygallium phthalocyanine Type V essentially free of chlorine, where a pigment precursor Type I chlorogallium phthalocyanine is prepared by the reaction of gallium chloride in a solvent, such as N-methylpyrrolidone, present in an amount of from about 10 to about 100 parts, with 1,3-diiminoisoindolene ($DI^3$) in an amount of from about 1 to about 10 parts, for each part of gallium chloride that is reacted; hydrolyzing said pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 to about 50 volume parts, for each weight part of pigment hydroxygallium phthalocyanine that is used by, for example, ball milling the Type I hydroxygallium phthalocyanine pigment in the presence of spherical glass beads, approximately 1 to 5 millimeters in diameter, at room temperature, about 25° C., for a period of from about 12 hours to about 1 week, and more specifically, about 24 hours.

The appropriate components, and processes of the above recited patents may be selected for the present disclosure in embodiments thereof.

SUMMARY

Disclosed in embodiments are imaging members with many of the advantages illustrated herein, such as extended lifetimes of service of, for example, in excess of about 1,500,000 imaging cycles; excellent electrical characteristics; stable electrical properties; excellent image ghosting characteristics; excellent lateral charge migration (LCM) resistance; excellent deletion resistance; acceptable background and/or minimal charge deficient spots (CDS); consistent $V_r$ (residual potential) that is substantially flat or no change over a number of imaging cycles as illustrated by the generation of known PIDC (Photoinduced Discharge Curve), and the like. Also disclosed are layered photoresponsive imaging members which are responsive to near infrared radiation of from about 700 to about 900 nanometers.

Further disclosed are layered flexible photoresponsive imaging members with sensitivity to visible light and with mechanically robust charge transport layers.

Additionally disclosed are flexible imaging members with optional hole blocking layers comprised of metal oxides, phenolic resins, and optional phenolic compounds, and which phenolic compounds contain at least two, and more specifically, two to ten phenol groups or phenolic resins with, for example, a weight average molecular weight ranging from about 500 to about 3,000 permitting, for example, a hole blocking layer with excellent efficient electron transport which usually results in a desirable photoconductor low residual potential $V_{low}$.

Embodiments

Aspects of the present disclosure relate to an imaging member comprising an optional supporting substrate, a photogenerating layer, and at least one charge transport layer comprised of at least one charge transport component, and where the photogenerating layer comprises a fatty ester, especially a vulcanized fatty ester; a photoconductor comprising a supporting substrate, a vulcanized fatty ester containing photogenerating layer, and at least one charge transport layer; a photoconductor where the fatty ester is present in an amount of from about 0.1 to about 30 weight percent, from about 1 to about 20 weight percent, from 1 to about 10 weight percent, from 1 to about 5 weight percent, from about 4 to about 6 weight percent, and yet more specifically, about 5 weight percent, and wherein the photogenerating layer is comprised of the fatty ester and a photogenerating pigment, and at least one charge transport layer comprised of a hole transport compound or compounds, and the at least one charge transport layer is 1, 2, or 3 layers; a photoconductor comprising a supporting substrate, a photogenerating layer, and at least one charge transport layer, and wherein the photogenerating layer includes therein a vulcanized fatty ester; a photoconductor comprising a supporting substrate, a vulcanized fatty ester containing photogenerating layer, and a charge transport layer, and wherein the photogenerating layer comprises a photogenerating component and the fatty ester; and a photoconductor comprising a photogenerating layer, and at least one charge transport layer, and wherein the photogenerating layer is comprised of at least one photogenerating pigment and a fatty ester, and wherein the fatty ester is present in an amount of from about 1 to about 12 weight percent, and the at least one charge transport layer is 1, 2, or 3 layers.

Various effective amounts of the fatty ester, and more specifically, the vulcanized fatty ester can be added to the photogenerating layer components such as, for example, from about 0.1 to about 30 weight percent, from about 1 to about 20 weight percent, from about 0.5 to about 30, from about 1 to about 20, from about 1 to about 10, or from about 1 to about 5 weight percent, and wherein the photogenerating layer and at least one charge transport layer include a resin binder, and wherein the at least one charge transport layer is from 2 to about 5 layers, and the photogenerating layer is situated between the substrate and the at least one charge transport layer; and a drum, or flexible xerographic imaging photoconductive member comprising a supporting substrate, a vulcanized fatty ester photogenerating layer, and at least two charge transport layers.

In embodiments thereof, there is disclosed a vulcanized fatty ester photoconductive imaging member comprised of a supporting substrate, a photogenerating layer thereover, a charge transport layer, and an overcoat charge transport layer; a photoconductive member with a photogenerating layer of a thickness of from about 0.1 to about 10 microns, at least one transport layer each of a thickness of from about 5 to about 100 microns; a xerographic imaging apparatus containing a charging component, a development component, a transfer component, and a fixing component, and wherein the apparatus contains a photoconductive imaging member comprised of a supporting substrate, and thereover a layer comprised of a photogenerating pigment and a fatty ester, and a charge transport layer or layers, and thereover an overcoat charge transport layer, and where the transport layer is of a thickness of from about 10 to about 75 microns; a member wherein the vulcanized fatty ester or mixtures thereof is present in an amount of from about 1 to about 20 weight percent, or from about 5 to about 10 weight percent; a member wherein the photogenerating layer contains a photogenerating pigment present in an amount of from about 10 to about 95 weight percent; a member wherein the thickness of the photogenerating layer is from about 0.2 to about 4 microns; a member wherein the photogenerating layer contains an inactive polymer binder; a member wherein the binder is present in an amount of from about 20 to about 90 percent by weight, and wherein the total of all layer components is about 100 percent; a member wherein the photogenerating component is a hydroxygallium phthalocyanine or a Manyl phthalocyanine that absorbs light of a wavelength of from about 370 to about 950 nanometers; an imaging member wherein the supporting substrate is comprised of a conductive substrate comprised of a metal; an imaging member wherein the conductive substrate is aluminum, aluminized polyethylene terephthalate, or titanized polyethylene terephthalate; an imaging member wherein the photogenerating resinous binder is selected from the group consisting of known suitable polymers like polyesters, polyvinyl butyrals, polycarbonates, polystyrene-b-polyvinyl pyridine, and polyvinyl formals; an imaging member wherein the photogenerating pigment is a metal free phthalocyanine; a photoconductor wherein each of the charge transport layers, especially a first and second layer, comprises

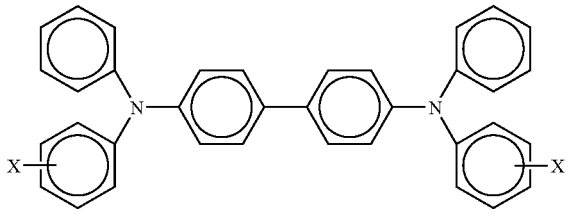

wherein X is selected from the group consisting of at least one of alkyl, alkoxy, and halogen such as methyl and chloride; and in embodiments where there is a total of four X substituents on each of the four terminating rings; an imaging member wherein alkyl and alkoxy contain from about 1 to about 15 carbon atoms; an imaging member wherein alkyl contains from about 1 to about 5 carbon atoms; an imaging member wherein alkyl is methyl; an imaging member wherein each of or at least one of the charge transport layers, especially a first and second charge transport layer, comprises

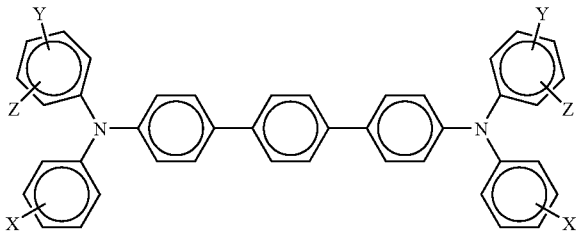

wherein X, Y and Z are independently selected from the group comprised of at least one of alkyl, alkoxy, aryl, and halogen, and in embodiments Z can be

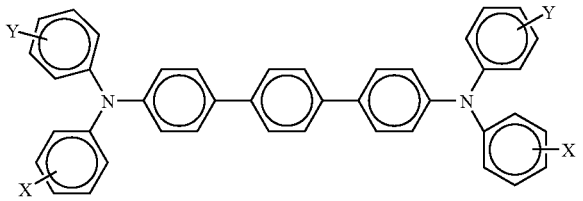

present, Y can be present, or both Y and Z are present; or wherein the charge transport component is

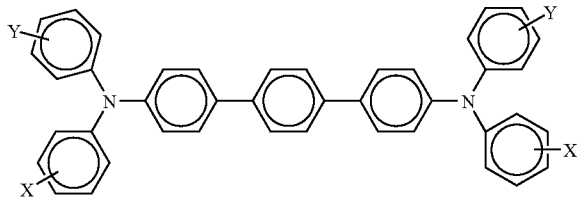

wherein X and Y are independently alkyl, alkoxy, aryl, a halogen, or mixtures thereof, an imaging member, and wherein, for example, alkyl and alkoxy contains from about 1 to about 15 carbon atoms; alkyl contains from about 1 to about 5 carbon atoms; and wherein the resinous binder is selected from the group consisting of polycarbonates, polyarylates, and polystyrene; a photoconductor for use in xerographic imaging and printing systems, such as the Xerox Corporation iGen3® machines, wherein the photogenerating pigment present in the photogenerating layer is comprised of chlorogallium phthalocyanine, titanyl phthalocyanine, or Type V hydroxygallium phthalocyanine prepared by hydrolyzing a gallium phthalocyanine precursor by dissolving the hydroxygallium phthalocyanine in a strong acid, and then reprecipitating the resulting dissolved precursor in a basic aqueous media; removing the ionic species formed by washing with water; concentrating the resulting aqueous slurry comprised of water and hydroxygallium phthalocyanine to a wet cake; removing water from the wet cake by drying; and subjecting the resulting dry pigment to mixing with the addition of a second solvent to cause the formation of the hydroxygallium phthalocyanine; an imaging member wherein the Type V hydroxygallium phthalocyanine has major peaks, as measured with an X-ray diffractometer, at Bragg angles (2 theta)+/−0.2° 7.4, 9.8, 12.4, 16.2, 17.6, 18.4, 21.9, 23.9, 25.0, 28.1 degrees, and the highest peak at 7.4 degrees; a method of imaging wherein the imaging member is exposed to light of a wavelength of from about 400 to about 950 nanometers; a member wherein the photogenerating layer is situated between the substrate and the charge transport layer; a member wherein the charge transport layer is situated between the substrate and the photogenerating layer, and wherein the number of charge transport layers is two; a member wherein the photogenerating layer is of a thickness of from about 0.1 to about 25 microns; a member wherein the photogenerating component amount is from about 0.05 to about 20 weight percent, and wherein the photogenerating pigment is dispersed in from about 10 to about 80 weight percent of a polymer binder; a member wherein the thickness of the photogenerating layer is from about 0.1 to about 11 microns; a member wherein the photogenerating and charge transport layer components are contained in a polymer binder, and wherein the binder is present in an amount of from about 50 to about 90 percent by weight, and wherein the total of the layer components is about 100 percent; a photoconductor wherein the photogenerating resinous binder is selected from the group consisting of at least one of polyesters, polyvinyl butyrals, polycarbonates, polystyrene-b-polyvinyl pyridine, and polyvinyl formals; an imaging member wherein the photogenerating component is Type V hydroxygallium phthalocyanine, titanyl phthalocyanine, chlorogallium phthalocyanine, or mixtures thereof, and the charge transport layer contains a hole transport of N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4'-r-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N-bis(3-chlorophenyl)[p-terphenyl]-4,4'-diamine molecules, and wherein the hole transport resinous binder is selected from the group consisting of polycarbonates and polystyrene; an imaging member wherein the photogenerating layer contains a metal free phthalocyanine; an imaging member wherein the photogenerating layer contains an alkoxygallium phthalocyanine; a photoconductive imaging member with a blocking layer contained as a coating on a substrate, and an adhesive layer coated on the blocking layer; an imaging member further containing an adhesive layer and a hole blocking layer; a color method of imaging which comprises generating an electrostatic latent image on the imaging member, developing the latent image, transferring, and fixing the developed electrostatic image to a suitable substrate; photoconductive imaging members comprised of a supporting substrate, a photogenerating layer, a hole transport layer, and a top overcoating layer in contact with the hole transport layer or, in embodiments, in contact with the photogenerating layer, and in embodiments wherein a plurality of charge transport layers are selected, such as for example, from 2 to about 10, and more specifically, 2 may be selected; and a photoconductive imaging member comprised of an optional supporting substrate, a photogenerating layer, and a first, second, and third charge transport layer.

Examples of the vulcanized fatty esters, incorporated into the photogenerating photoconductors disclosed herein, and available from RheinChemie, such as ADDITIN® RC8000, can be prepared from vulcanization (sulfurization) of unsaturated fatty esters. Sulfur sources that may be used in the sulfurization reaction include elemental sulfur, sulfur monochloride, sulfur dichloride, sodium sulfide, sodium polysulfide, and mixtures of these added together or at different stages of the sulfurization process. Examples of unsaturated fatty esters that can be selected for the vulcanization reaction are, for example, corn oil, canola oil, cottonseed oil, grapeseed oil, olive oil, palm oil, peanut oil, coconut oil, rapeseed oil, safflower seed oil, sesame seed oil, soybean oil, sunflower seed oil, tallow, and mixtures thereof. A typical reaction mechanism is as follows

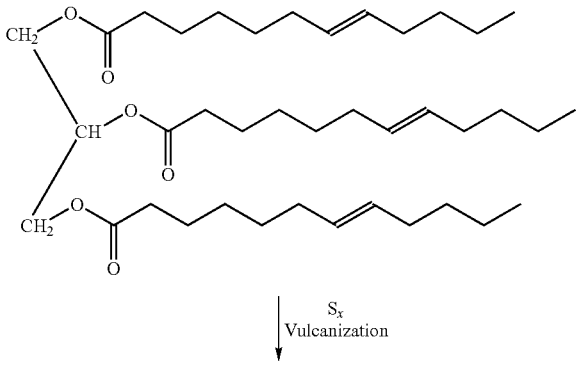

-continued

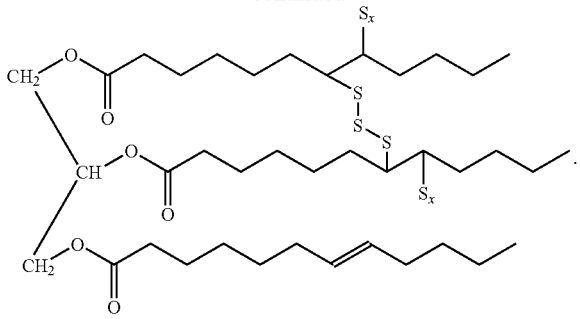

Typically, from about 60 to about 95 parts of a fatty ester is mixed with from about 40 to about 5 parts of sulfur ($S_x$, where x=8), and heated to about 120° C. to about 200° C., or 170° C., for about 5 to about 120 minutes, or more specifically, about 30 minutes. The resulting vulcanized fatty esters possess a sulfur content of, for example, from about 5 to about 40 weight percent, from about 10 to about 30 weight percent, from about 10 to about 20 weight percent, and the like.

Generally, the fatty esters selected for the photogenerating layer possess unsaturation in the aliphatic chains, and where these reactive chains are reacted with, for example, sulfur, and where the resulting vulcanized fatty ester containing photogenerating layer enables a number of the advantages illustrated herein, and for example, substantial adhesion of the photogenerating layer to the substrate and the charge transport layers, and where when tested no peeling of the photoconductor layers was observed.

Specific examples of vulcanized fatty esters that may be selected for inclusion in the photogenerating layer are sulfurized corn oil, sulfurized canola oil, sulfurized cottonseed oil, sulfurized grapeseed oil, sulfurized olive oil, sulfurized palm oil, sulfurized peanut oil, sulfurized coconut oil, sulfurized rapeseed oil, sulfurized sesame seed oil, sulfurized soybean oil, sulfurized sunflower seed oil, sulfurized tallow, sulfurized fish oil including herring oil and sardine oil. Commercial vulcanized fatty ester examples that may be selected for inclusion in the photogenerating layer are ADDITIN® RC8000 which contains approximately 20 weight percent sulfur content, ADDITIN® R4410 which contains approximately 9.5 weight percent sulfur content, ADDITIN® R4412-F which contains approximately 12.5 weight percent sulfur content, ADDITIN® R4417 which contains approximately 17.5 weight percent sulfur content, ADDITIN® RC2515 which contains approximately 15 weight percent sulfur content, ADDITIN® RC2526 which contains approximately 26 weight percent sulfur content, ADDITIN® RC2810-A which contains approximately 10 weight percent sulfur content, ADDITIN® RC2814-A which contains approximately 14 weight percent sulfur content, and ADDITIN® RC2818-A which contains approximately 16 weight percent sulfur content, all from RheinChemie Corporation.

PHOTOCONDUCTOR LAYER EXAMPLES

There can be selected for the photoconductors disclosed herein a number of known layers, such as substrates, photogenerating layers, charge transport layers (CTL), hole blocking layers, adhesive layers, protective overcoat layers, and the like. Examples, thicknesses, specific components of many of these layers include the following.

The thickness of the substrate layer depends on many factors, including economical considerations, electrical characteristics, and the like, thus this layer may be of a substantial thickness, for example over 3,000 microns, such as from about 1,000 to about 3,500 microns, from about 1,000 to about 2,000 microns, from about 300 to about 700 microns, or of a minimum thickness of, for example, about 100 to about 500 microns. In embodiments, the thickness of this layer is from about 75 to about 300 microns, or from about 100 to about 150 microns.

The substrate may be opaque or substantially transparent, and may comprise any suitable material. Accordingly, the substrate may comprise a layer of an electrically nonconductive or conductive material, such as an inorganic or an organic composition. As electrically nonconducting materials, there may be employed various resins known for this purpose including polyesters, polycarbonates, polyamides, polyurethanes, and the like, which are flexible as thin webs. An electrically conducting substrate may be any suitable metal of, for example, aluminum, nickel, steel, copper, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors, including strength desired and economical considerations. For a drum, this layer may be of a substantial thickness of, for example, up to many centimeters, or of a minimum thickness of less than a millimeter. Similarly, a flexible belt may be of a substantial thickness of, for example, about 250 microns, or of a minimum thickness of less than about 50 microns, provided there are no adverse effects on the final electrophotographic device. In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

Illustrative examples of substrates are as illustrated herein, and more specifically, layers selected for the imaging members of the present disclosure, and which substrates can be opaque or substantially transparent comprise a layer of insulating material including inorganic or organic polymeric materials, such as MYLAR® a commercially available polymer, MYLAR® containing titanium, a layer of an organic or inorganic material having a semiconductive surface layer, such as indium tin oxide or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

The photogenerating layer, in embodiments, is comprised of a number of known photogenerating pigments, such as for example, about 50 weight percent of Type V hydroxygallium phthalocyanine, titanyl phthalocyanine or chlorogallium phthalocyanine, and about 50 weight percent of a resin binder like poly(vinyl chloride-co-vinyl acetate) copolymer, such as VMCH (available from Dow Chemical), or polycarbonate.

Generally, the photogenerating layer can contain known photogenerating pigments, such as metal phthalocyanines, metal free phthalocyanines, alkylhydroxyl gallium phthalocyanines, hydroxygallium phthalocyanines, chlorogallium phthalocyanines, perylenes, especially bis(benzimidazo) perylene, titanyl phthalocyanines, and the like, and more specifically, vanadyl phthalocyanines, Type V hydroxygallium phthalocyanines, and inorganic components, such as selenium, selenium alloys, and trigonal selenium. The photogenerating pigment can be dispersed in a resin binder similar to the resin binders selected for the charge transport layer, or alternatively no resin binder need be present. Generally, the thickness of the photogenerating layer depends on a number of factors, including the thicknesses of the other layers, and the amount of photogenerating material contained in the photogenerating layer. Accordingly, this layer can be of a thickness of, for example, from about 0.05 to about 10 microns, and more specifically, from about 0.25 to about 2 microns when, for example, the photogenerating compositions are present in an amount of from about 30 to about 75 percent by volume. The maximum thickness of this layer in embodiments is dependent primarily upon factors, such as photosensitivity, electrical properties, and mechanical considerations. The photogenerating layer binder resin is present in various suitable amounts, for example from about 1 to about 50 weight percent, and more specifically, from about 1 to about 10 weight percent, and which resin may be selected from a number of known polymers, such as poly(vinyl butyral), poly (vinyl carbazole), polyesters, polycarbonates, polyarylates, poly(vinyl chloride), polyacrylates and methacrylates, copolymers of vinyl chloride and vinyl acetate, phenolic resins, polyurethanes, poly(vinyl alcohol), polyacrylonitrile, polystyrene, other known suitable binders, and the like. It is desirable to select a coating solvent that does not substantially disturb or adversely affect the previously coated layers of the device. Examples of coating solvents for the photogenerating layer are ketones, alcohols, aromatic hydrocarbons, halogenated aliphatic hydrocarbons, silanols, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, dichloroethane, tetrahydrofuran, dioxane, diethyl ether, dimethyl formamide, dimethyl acetamide, butyl acetate, ethyl acetate, methoxyethyl acetate, and the like.

The photogenerating layer may comprise amorphous films of selenium and alloys of selenium and arsenic, tellurium, germanium, and the like; hydrogenated amorphous silicon; and compounds of silicon and germanium, carbon, oxygen, nitrogen, and the like fabricated by vacuum evaporation or deposition. The photogenerating layers may also comprise inorganic pigments of crystalline selenium and its alloys; Groups II to VI compounds; and organic pigments, such as quinacridones, polycyclic pigments, such as dibromo anthanthrone pigments, perylene and perinone diamines, polynuclear aromatic quinones, azo pigments including bis-, tris- and tetrakis-azos; and the like dispersed in a film forming polymeric binder, and fabricated by solvent coating techniques.

Infrared sensitivity can be desired for photoreceptors exposed to low cost semiconductor laser diode light exposure devices where, for example, the absorption spectrum and photosensitivity of the phthalocyanines selected depend on the central metal atom thereof. Examples of these phthalocyanines selected for the photogenerating layer of the photoconductors of the present disclosure include oxyvanadium phthalocyanine, chloroaluminum phthalocyanine, copper phthalocyanine, oxytitanium phthalocyanine, chlorogallium phthalocyanine, hydroxygallium phthalocyanine, magnesium phthalocyanine, and metal free phthalocyanine. The phthalocyanines exist in many crystal forms, and have a strong influence on photogeneration.

A number of titanyl phthalocyanines, or oxytitanium phthalocyanines photogenerating pigments or components can be selected for the photoconductors illustrated herein inclusive of photogenerating pigments known to absorb near infrared light at, for example, about 800 nanometers, and which exhibit improved sensitivity compared to other pigments, such as, for example, hydroxygallium phthalocyanine. Generally, titanyl phthalocyanine is known to have five main crystal forms known as Types I, II, III, X, and IV. For example, U.S. Pat. Nos. 5,189,155 and 5,189,156, the disclosures of which are totally incorporated herein by reference, disclose a number of methods for obtaining various polymorphs of titanyl phthalocyanine. Additionally, U.S. Pat. Nos. 5,189,155 and 5,189,156 are directed to processes for obtaining Types I, X, and IV phthalocyanines. U.S. Pat. No. 5,153,094, the disclosure of which is totally incorporated herein by reference, relates to the preparation of titanyl phthalocyanine polymorphs including Types I, II, III, and IV polymorphs. U.S. Pat. No. 5,166,339, the disclosure of which is totally incorporated herein by reference, discloses processes for preparing Types I, IV, and X titanyl phthalocyanine polymorphs, as well as the preparation of two polymorphs designated as Type Z-1 and Type Z-2.

To obtain a titanyl phthalocyanine pigment based photoconductor with high sensitivity to near infrared light, it is believed of value to control not only the purity and chemical structure of the pigment, as is generally the situation with organic photoconductors, but also to prepare the pigment in a certain crystal modification. Consequently, it is desirable to provide a photoconductor where the titanyl phthalocyanine is generated by a process that will provide high sensitivity titanyl phthalocyanines.

In embodiments, the Type V phthalocyanine pigment included in the photogenerating layer can be generated by dissolving Type I titanyl phthalocyanine in a solution comprising a trihaloacetic acid and an alkylene halide; adding the resulting mixture comprising the dissolved Type I titanyl phthalocyanine to a solution comprising an alcohol and an alkylene halide thereby precipitating a Type Y titanyl phthalocyanine; and treating the resulting Type Y titanyl phthalocyanine with monochlorobenzene.

With further respect to the titanyl phthalocyanines selected for the photogenerating layer, such phthalocyanines can exhibit a crystal phase that is distinguishable from other known titanyl phthalocyanine polymorphs, and are designated as Type V polymorphs prepared by converting a Type I titanyl phthalocyanine to a Type V titanyl phthalocyanine pigment. The processes include converting a Type I titanyl phthalocyanine to an intermediate titanyl phthalocyanine, which is designated as a Type Y titanyl phthalocyanine, and then subsequently converting the Type Y titanyl phthalocyanine to a Type V titanyl phthalocyanine.

In one embodiment, the titanyl phthalocyanine process comprises (a) dissolving a Type I titanyl phthalocyanine in a suitable solvent; (b) adding the solvent solution comprising the dissolved Type I titanyl phthalocyanine to a quenching solvent system to precipitate an intermediate titanyl phthalocyanine (designated as a Type Y titanyl phthalocyanine); and (c) treating the resultant Type Y phthalocyanine with a halo, such as, for example, monochlorobenzene, to obtain a resultant high sensitivity titanyl phthalocyanine, which is designated herein as a Type V titanyl phthalocyanine. In another embodiment, prior to treating the Type Y phthalocyanine with a halo, such as monochlorobenzene, the Type Y titanyl phthalocyanine may be washed with various solvents including, for example, water, and/or methanol. The quenching solvents system to which the solution comprising the dissolved Type I titanyl phthalocyanine is added comprises, for example, an alkyl alcohol and an alkylene halide.

The titanyl phthalocyanine process further provides a titanyl phthalocyanine having a crystal phase distinguishable from other known titanyl phthalocyanines. The titanyl phthalocyanine Type V prepared by a process illustrated herein is distinguishable from, for example, Type IV titanyl phthalocyanines in that a Type V titanyl phthalocyanine exhibits an X-ray powder diffraction spectrum having four characteristic peaks at 9.0°, 9.6°, 24.0°, and 27.2°, while Type IV titanyl phthalocyanines typically exhibit only three characteristic peaks at 9.6°, 24.0°, and 27.2°.

In a process embodiment for preparing a high sensitivity phthalocyanine, a Type I titanyl phthalocyanine is dissolved in a suitable solvent. In embodiments, a Type I titanyl phthalocyanine is dissolved in a solvent comprising a trihaloacetic acid and an alkylene halide. The alkylene halide comprises, in embodiments, from about one to about six carbon atoms. An example of a suitable trihaloacetic acid includes, but is not limited to, trifluoroacetic acid. In one embodiment, the solvent for dissolving a Type I titanyl phthalocyanine comprises trifluoroacetic acid and methylene chloride. In embodiments, the trihaloacetic acid is present in an amount of from about one to about 100 volume parts of the solvent, and the alkylene halide is present in an amount of from about one to about 100 volume parts of the solvent. In one embodiment, the solvent comprises methylene chloride and trifluoroacetic acid in a volume-to-volume ratio of about 4 to 1. The Type I titanyl phthalocyanine is dissolved in the solvent by stirring for an effective period of time, such as, for example, for about 30 seconds to about 24 hours, at room temperature. The Type I titanyl phthalocyanine is dissolved by, for example, stirring in the solvent for about one hour at room temperature (about 25° C.). The Type I titanyl phthalocyanine may be dissolved in the solvent in either air, or in an inert atmosphere (argon or nitrogen).

Examples of binders for the photogenerating layer are thermoplastic and thermosetting resins, such as polycarbonates, polyesters, polyamides, polyurethanes, polystyrenes, polyarylsilanols, polyarylsulfones, polybutadienes, polysulfones, polysilanolsulfones, polyethylenes, polypropylenes, polyimides, polymethylpentenes, poly(phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly(vinyl chloride), vinyl chloride and vinyl acetate copolymers, acrylate copolymers, alkyd resins, cellulosic film formers, poly(amideimide), styrene butadiene copolymers, vinylidene chloride-vinyl chloride copolymers, vinyl acetate-vinylidene chloride copolymers, styrene-alkyd resins, poly (vinyl carbazole), and the like. These polymers may be block, random, or alternating copolymers.

The photogenerating composition or pigment is present in the resinous binder composition in various amounts. Generally, however, from about 5 to about 90 percent by weight of the photogenerating pigment is dispersed in about 10 to about 95 percent by weight of the resinous binder, or from about 20 to about 50 percent by weight of the photogenerating pigment is dispersed in about 80 to about 50 percent by weight of the resinous binder composition. In one embodiment, about 50 percent by weight of the photogenerating pigment is dispersed in about 50 percent by weight of the resinous binder composition.

Various suitable and conventional known processes may be used to mix, and thereafter apply the photogenerating layer coating mixture like spraying, dip coating, roll coating, wire wound rod coating, vacuum sublimation, and the like. For some applications, the photogenerating layer may be fabricated in a dot or line pattern. Removal of the solvent of a solvent-coated photogenerating layer may be effected by any known conventional techniques such as oven drying, infrared radiation drying, air drying, and the like.

The coating of the photogenerating layer in embodiments of the present disclosure can be accomplished to achieve a final dry thickness of the photogenerating layer as illustrated herein, and for example, from about 0.01 to about 30 microns after being dried at, for example, about 40° C. to about 150° C. for about 1 to about 90 minutes. More specifically, a photogenerating layer of a thickness, for example, of from about 0.1 to about 30 microns, or from about 0.5 to about 2 microns can be applied to or deposited on the substrate, on other surfaces in between the substrate and the charge transport layer, and the like. A charge blocking layer or hole blocking layer may optionally be applied to the electrically conductive surface prior to the application of a photogenerating layer. When desired, an adhesive layer may be included between the charge blocking, hole blocking layer, or interfacial layer, and the photogenerating layer. Usually, the photogenerating layer is applied onto the blocking layer, and a charge transport layer or plurality of charge transport layers are formed on the photogenerating layer. The photogenerating layer may be applied on top of or below the charge transport layer.

In embodiments, a suitable known adhesive layer can be included in the photoconductor. Typical adhesive layer materials include, for example, polyesters, polyurethanes, and the like. The adhesive layer thickness can vary, and in embodiments is, for example, from about 0.05 to about 0.3 micron. The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying, and the like.

As an optional adhesive layer or layers usually in contact with or situated between the hole blocking layer and the photogenerating layer, there can be selected various known substances inclusive of copolyesters, polyamides, poly(vinyl butyral), poly(vinyl alcohol), polyurethane, and polyacrylonitrile. This layer is, for example, of a thickness of from about 0.001 to about 1 micron, or from about 0.1 to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure further desirable electrical and optical properties.

The optional hole blocking or undercoat layer for the imaging members of the present disclosure can contain a number of components including known hole blocking components, such as amino silanes, doped metal oxides, a metal oxide like titanium, chromium, zinc, tin, and the like; a mixture of phenolic compounds and a phenolic resin, or a mixture of two phenolic resins, and optionally a dopant such as $SiO_2$. The phenolic compounds usually contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene)bisphenol), P (4,4'-(1,4-phenylene diisopropylidene)bisphenol), S (4,4'-sulfonyldiphenol), and Z (4,4'-cyclohexylidenebisphenol); hexafluorobisphenol A (4,4'-(hexafluoro isopropylidene) diphenol), resorcinol, hydroxyquinone, catechin, and the like.

The hole blocking layer can be, for example, comprised of from about 20 to about 80 weight percent, and more specifically, from about 55 to about 65 weight percent of a suitable component like a metal oxide, such as $TiO_2$; from about 20 to about 70 weight percent, and more specifically, from about 25 to about 50 weight percent of a phenolic resin; from about 2 to about 20 weight percent, and more specifically, from about 5 to about 15 weight percent of a phenolic compound containing, for example, at least two phenolic groups, such as bisphenol S; and from about 2 to about 15 weight percent, and more specifically, from about 4 to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9 nanometers. To the above dispersion are added a phenolic compound and dopant followed by mixing. The hole blocking layer coating dispersion can be applied by dip coating or web coating, and the layer can be thermally cured after coating. The hole blocking layer resulting is, for example, of a thickness of from about 0.01 to about 30 microns, and more specifically, from about 0.1 to about 8 microns. Examples of phenolic resins include formaldehyde polymers with phenol, p-tert-butylphenol, cresol, such as VARCUM® 29159 and 29101 (available from OxyChem Company), and DURITE® 97 (available from Borden Chemical); formaldehyde polymers with ammonia, cresol and phenol, such as VARCUM® 29112 (available from OxyChem Company); formaldehyde polymers with 4,4'-(1-methylethylidene)bisphenol, such as VARCUM® 29108 and 29116 (available from OxyChem Company); formaldehyde polymers with cresol and phenol, such as VARCUM® 29457 (available from OxyChem Company), DURITE® SD-423A, SD-422A (available from Borden Chemical); or formaldehyde polymers with phenol and p-tert-butylphenol, such as DURITE® ESD 556C (available from Borden Chemical).

Charge transport layer components and molecules include a number of known materials as illustrated herein, such as aryl amines, which layer is generally of a thickness of from about 5 to about 75 microns, and more specifically, of a thickness of from about 10 to about 40 microns. Examples of charge transport layer components include

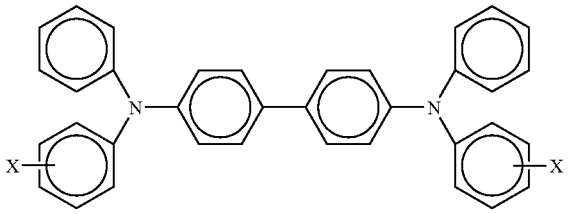

wherein X is alkyl, alkoxy, aryl, a halogen, or mixtures thereof, and especially those substituents selected from the group consisting of Cl and $CH_3$; and molecules of the following formula

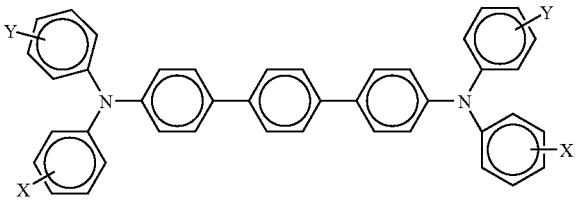

wherein X and Y are independently alkyl, alkoxy, aryl, a halogen, or mixtures thereof.

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide and fluoride. Substituted alkyls, alkoxys, and aryls can also be selected in embodiments.

Examples of specific aryl amines include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis (halophenyl)-1,1'-biphenyl-4,4'-diamine wherein the halo substituent is a chloro substituent; N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4'-diamine, and the like. Other known charge transport layer molecules can be selected, reference for example, U.S. Pat. Nos. 4,921,773 and 4,464,450, the disclosures of which are totally incorporated herein by reference.

Examples of polymer binder materials for the charge transport layer or layers include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly (4,4'-isopropylidene-diphenylene)carbonate (also referred to as bisphenol-A-polycarbonate), poly(4,4'-cyclohexylidine-diphenylene)carbonate (also referred to as bisphenol-Z-polycarbonate), poly(4,4'-isopropylidene-3,3'-dimethyl-diphenyl)carbonate (also referred to as bisphenol-C-polycarbonate), and the like. In embodiments, the charge transport layer binders are comprised of polycarbonate resins with a weight average molecular weight of from about 20,000 to about 100,000, or with a molecular weight $M_w$ of from about 50,000 to about 100,000 preferred. Generally, in embodiments the transport layer contains from about 10 to about 75 percent by weight of the charge transport material, and more specifically, from about 35 to about 50 percent of this material.

The charge transport layer or layers, and more specifically, a first charge transport in contact with the photogenerating layer, and thereover a top or second charge transport overcoating layer may comprise charge transporting small molecules dissolved or molecularly dispersed in a film forming electrically inert polymer such as a polycarbonate. In embodiments, "dissolved" refers, for example, to forming a solution in which the small molecule and silanol are dissolved in the polymer to form a homogeneous phase; and "molecularly dispersed in embodiments" refers, for example, to charge transporting molecules dispersed in the polymer, the small molecules being dispersed in the polymer on a molecular scale. Various charge transporting or electrically active small molecules may be selected for the charge transport layer or layers. In embodiments, charge transport refers, for example, to charge transporting molecules as a monomer that allows the free charge generated in the photogenerating layer to be transported across the transport layer.

Examples of hole transporting molecules, especially for the first and second charge transport layers, and present, for example, in an amount of from about 45 to about 80 weight percent, include, for example, pyrazolines such as 1-phenyl-3-(4'-diethylamino styryl)-5-(4"-diethylamino phenyl)pyrazoline; aryl amines such as N,N'-diphenyl-N,N-bis(3-methylphenyl)-(1,1'-biphenyl)-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4'-diamine; hydrazones such as N-phenyl-N-methyl-3-(9-ethyl) carbazyl hydrazone, and 4-diethyl amino benzaldehyde-1,2-diphenyl hydrazone; and vulcanized fatty esters, such as 2,5-bis(4-N,N'-diethylaminophenyl)-1,2,4-vulcanized fatty ester, stilbenes, and the like. However, in embodiments, to minimize or avoid cycle-up in equipment, such as printers, with high throughput, the charge transport layer should be substantially free (less than about two percent) of di or tri-amino-triphenyl methane. A small molecule charge transporting compound that permits injection of holes into the photogenerating layer with high efficiency, and transports them across the charge transport layer with short transit times, and which layer contains a binder and a silanol includes N,N'-diphenyl-N,N'-bis(3-methylphenyl)-(1,1'-biphenyl)-4,4'-diamine, N,N'-bis(4-butylphenyl)-N,N'-di-m-tolyl-di-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, and N,N'-diphenyl-N,N'-bis(3-chlorophenyl)-[p-terphenyl]-4,4'-diamine, or mixtures thereof. If desired, the charge transport material in the charge transport layer may comprise a polymeric charge transport material, or a combination of a small molecule charge transport material and a polymeric charge transport material.

The thickness of each of the charge transport layers in embodiments is from about 5 to about 75 microns, but thicknesses outside this range may, in embodiments, also be selected. The charge transport layer should be an insulator to the extent that an electrostatic charge placed on the hole transport layer is not conducted in the absence of illumination at a rate sufficient to prevent formation and retention of an electrostatic latent image thereon. In general, the ratio of the thickness of the charge transport layer to the photogenerating layer can be from about 2:1 to 200:1, and in some instances 400:1. The charge transport layer is substantially nonabsorbing to visible light or radiation in the region of intended use, but is electrically "active" in that it allows the injection of photogenerated holes from the photoconductive layer, or photogenerating layer, and allows these holes to be transported through itself to selectively discharge a surface charge on the surface of the active layer.

The thickness of the continuous charge transport overcoat layer selected depends upon the abrasiveness of the charging (bias charging roll), cleaning (blade or web), development (brush), transfer (bias transfer roll), and the like in the system employed, and can be up to about 10 microns. In embodiments, this thickness for each layer is from about 1 to about 5 microns. Various suitable and conventional methods may be used to mix, and thereafter apply the overcoat layer coating mixture to the photoconductor. Typical application techniques include spraying, dip coating, roll coating, wire wound rod coating, and the like. Drying of the deposited coating may be effected by any suitable conventional technique, such as oven drying, infrared radiation drying, air drying, and the like. The dried overcoating layer of this disclosure should transport holes during imaging and should not have too high a free carrier concentration.

The overcoat can comprise the same components as the charge transport layer wherein the weight ratio between the charge transporting small molecules, and the suitable electrically inactive resin binder is, for example, from about 0/100 to about 60/40, or from about 20/80 to about 40/60.

Examples of components or materials optionally incorporated into the charge transport layers or at least one charge transport layer to, for example, enable excellent lateral charge migration (LCM) resistance include hindered phenolic antioxidants, such as tetrakis methylene(3,5-di-tert-butyl-4-hydroxy hydrocinnamate)methane (IRGANOX® 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Company, Ltd.), IRGANOX® 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Company, Ltd.); hindered amine antioxidants such as SANOL™ LS-2626, LS-765, LS-770 and LS-744 (available from SNKYO CO., Ltd.), TINUVIN® 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules, such as bis(4-diethylamino-2-methylphenyl)phenylmethane (BDETPM), bis-[2-methyl-4-(N-2-hydroxyethyl-N-ethyl-aminophenyl)]-phenylmethane (DHTPM), and the like. The weight percent of the antioxidant in at least one of the charge transport layers is from about 0 to about 20, from about 1 to about 10 weight percent, or from about 3 to about 8 weight percent.

Primarily for purposes of brevity, the examples of each of the substituents, and each of the components/compounds/molecules, polymers, (components) for each of the layers, specifically disclosed herein, are not intended to be exhaustive. Thus, a number of components, polymers, formulas, structures, and R group or substituent examples, and carbon chain lengths not specifically disclosed or claimed are intended to be encompassed by the present disclosure and claims. Also, the carbon chain lengths are intended to include all numbers between those disclosed or claimed or envisioned, thus from 1 to about 20 carbon atoms, and from 6 to about 36 carbon atoms includes 1, 2, 3, 4, 5, 6, 7, 8, 9, 10, 11, 12, 13, 14, 15, up to 36, or more. At least one refers, for example, to from 1 to about 5, from 1 to about 2, 1, 2, and the like. Similarly, the thickness of each of the layers, the examples of components in each of the layers, the amount ranges of each of the components disclosed and claimed is not exhaustive, and it is intended that the present disclosure and claims encompass other suitable parameters not disclosed or that may be envisioned.

The following Examples are being submitted to illustrate embodiments of the present disclosure. These Examples are intended to be illustrative only, and are not intended to limit the scope of the present disclosure. Also, parts and percentages are by weight unless otherwise indicated. A Comparative Example and data are also provided.

Comparative Example 1

There was prepared a photoconductor with a biaxially oriented polyethylene naphthalate substrate (KALEDEX™ 2000) having a thickness of 3.5 mils, and thereover, a 0.02 micron thick titanium layer was coated on the biaxially oriented polyethylene naphthalate substrate (KALEDEX™ 2000). Subsequently, there was applied thereon, with an extrusion coater (Hirano web coater), a hole blocking layer solution containing 50 grams of 3 aminopropyl triethoxysilane (γ-APS), 41.2 grams of water, 15 grams of acetic acid, 684.8 grams of denatured alcohol, and 200 grams of heptane. This layer was then dried for about 1 minute at 120° C. in a forced air dryer. The resulting hole blocking layer had a dry thickness of 500 Angstroms. An adhesive layer was then deposited by applying a wet coating over the blocking layer, using an extrusion coater, and which adhesive contained 0.2 percent by weight based on the total weight of the solution of the copolyester adhesive (ARDEL D100™ available from Toyota Hsutsu Inc.) in a 60:30:10 volume ratio mixture of tetrahydrofuran/monochlorobenzene/methylene chloride. The adhesive layer was then dried for about 1 minute at 120° C. in the forced air dryer of the coater. The resulting adhesive layer had a dry thickness of 200 Angstroms.

A photogenerating layer dispersion was prepared by introducing 0.45 gram of the known polycarbonate IUPILON 200™ (PCZ-200) weight average molecular weight of 20,000, available from Mitsubishi Gas Chemical Corporation, and 44.65 grams of tetrahydrofuran (THF) into a 4 ounce glass bottle. To this solution were added 2.4 grams of hydroxygallium phthalocyanine (Type V) and 300 grams of ⅛ inch (3.2 millimeters) diameter stainless steel shot. This mixture was then placed on a ball mill for 3 hours. Subsequently, 2.25 grams of PCZ-200 were dissolved in 46.1 grams of THF, and added to the hydroxygallium phthalocyanine dispersion. This slurry was then placed on a shaker for 10 minutes. The resulting dispersion was, thereafter, applied to the above adhesive interface with an extrusion coater. A strip about 10 millimeters wide along one edge of the substrate web bearing the blocking layer and the adhesive layer was deliberately left uncoated by any of the photogenerating layer material to facilitate adequate electrical contact by the ground strip layer that was applied later. The photogenerating layer was dried at 120° C. for 1 minute in a forced air oven to form a dry photogenerating layer of hydroxygallium phthalocyanine Type V and PCZ-200 with a weight ratio of about 47/53, and having a thickness of 0.8 micron.

The resulting imaging member web was then overcoated with two charge transport layers. Specifically, the photogenerating layer was overcoated with a first pass charge transport layer (the bottom layer) in contact with the photogenerating layer. The bottom layer of the charge transport layer was prepared by introducing into an amber glass bottle in a weight ratio of 1:1 N,N'-diphenyl-N,N'-bis(3-methylphenyl)-1,1'-biphenyl-4,4'-diamine and MAKROLON® 5705, a known polycarbonate resin having a molecular weight average of from about 50,000 to about 100,000, commercially available from Farbenfabriken Bayer A.G. The resulting mixture was then dissolved in methylene chloride to form a solution containing 15 percent by weight solids. This solution was applied on the photogenerating layer to form the bottom layer coating that upon drying (120° C. for 1 minute) had a thickness of 14.5 microns. During this coating process, the humidity was equal to or somewhat less than 15 percent.

The bottom layer of the charge transport layer was then overcoated with a second pass top layer. The charge transport layer solution of the top layer was prepared by introducing into an amber glass bottle in a weight ratio of 0.35:0.65 N,N'-diphenyl-N,N'-bis(3-methylphenyl)-1,1'-biphenyl-4,4'-diamine and MAKROLON® 5705, a known polycarbonate resin having a molecular weight average of from about 50,000 to about 100,000, commercially available from Farbenfabriken Bayer A.G. The resulting mixture was then dissolved in methylene chloride to form a solution containing 15 percent by weight solids. The resulting top layer solution was applied on the bottom layer of the charge transport layer to form a coating that upon drying (120° C. for 1 minute) had a thickness of 14.5 microns. During this coating process, the humidity was equal to or somewhat less than 15 percent.

Example I

A photoconductive member was prepared by repeating the process of Comparative Example 1 except that there was included in the photogenerating layer dispersion 5 weight percent of the vulcanized fatty ester ADDITIN® RC8000, which contained approximately 20 weight percent sulfur, and which vulcanized fatty ester was obtained from RheinChemie with the ratio of hydroxygallium phthalocyanine to the polycarbonate resin to the vulcanized fatty ester being 44.8/50.5/4.7 in THF. The resulting dispersion was, thereafter, applied on the adhesive layer with an extrusion coater. The resulting member with the vulcanized fatty ester photogenerating layer was dried at 120° C. for 1 minute in a forced air oven to form a dry photogenerating layer of hydroxygallium phthalocyanine Type V, PCZ-200 and the fatty ester with a weight ratio of about 44.8/50.5/4.7, and having a thickness of 0.8 micron.

Example II

A number of xerographic photoconductors member are prepared by repeating the process of Example I except that there is selected in place of the fatty ester ADDITIN® RC8000, 10 weight percent of ADDITIN® R4410 which contains approximately 9.5 weight percent sulfur content, ADDITIN® R4412-F which contains approximately 12.5 weight percent sulfur content, ADDITIN® R4417 which contains approximately 17.5 weight percent sulfur content, ADDITIN® RC2515 which contains approximately 15 weight percent sulfur content, ADDITIN® RC2526 which contains approximately 26 weight percent sulfur content, ADDITIN® RC2810-A which contains approximately 10 weight percent sulfur content, ADDITIN® RC2814-A which contains approximately 14 weight percent sulfur content, or ADDITIN® RC2818-A which contains approximately 16 weight percent sulfur content, all obtained from RheinChemie.

Electrical Property Testing

The above prepared photoconductor devices of Comparative Example 1 and Examples I were tested in a scanner set to obtain photoinduced discharge cycles, sequenced at one charge-erase cycle followed by one charge-expose-erase cycle, wherein the light intensity was incrementally increased with cycling to produce a series of photoinduced discharge characteristic curves from which the photosensitivity and surface potentials at various exposure intensities are measured. Additional electrical characteristics were obtained by a series of charge-erase cycles with incrementing surface potential to generate several voltage versus charge density curves. The scanner was equipped with a scorotron set to a constant voltage charging at various surface potentials. The devices were tested at surface potentials of 400 volts with the exposure light intensity incrementally increased by means of regulating a series of neutral density filters; the exposure light source was a 780 nanometer light emitting diode. Xerographic simulation was completed in an environmentally controlled light tight chamber at ambient conditions (40 percent relative humidity and 22° C.).

Similar PIDC curves were obtained for the above photoconductors. Thus, incorporation of the vulcanized fatty ester into the photogenerating layer had substantially no negative impact on the electrical properties of the photoconductors.

Ghosting Measurements

When a photoconductor is selectively exposed to positive charges in a number of known xerographic print engines, some of these charges may enter the photoconductor and manifest themselves as a latent image in the next printing cycle. This print defect can cause a change in the lightness of the half tones, and is commonly referred to as a "ghost" that is generated in the previous printing cycle.

An example of a source of the positive charges is the stream of positive ions that may be emitted from the transfer corotron. Since the paper sheets are situated between the transfer corotron and the photoconductor, the photoconductor is shielded from the positive ions from the paper sheets. In the areas between the paper sheets, the photoconductor is fully exposed, thus in this paper free zone the positives charges may enter the photoconductor. As a result, these charges cause a print defect or ghost in a half tone print when changing to a larger paper format that covers the previous paper free zone.

In the ghosting test, the photoconductors were electrically cycled to simulate continuous printing. At the end of every tenth cycle known, incremental positive charges were injected. In the follow-on cycles, the electrical response to these injected charges were measured in a known electrical test fixture, and then translated into a rating scale.

The electrical response to the injected charges in the above known xerographic print engine and in the electrical test fixture resulted in a drop in the surface potential. This drop was calibrated to colorimetric values in the prints generated, and they in turn were calibrated to a ranking scale of an average rating of at least two observers. On this scale, 1 refers to no observable ghost, and values of 7 or above refer to a very strong ghost. The functional dependence between the change in surface potential and the ghosting scale is slightly supralinear, and may in first approximation be linearly scaled. The ghosting tests were completed under severe stress conditions, for example, actuators in the print engine and in the test fixture are set in a manner that have the potential to arrive at unacceptable ghosting.

Using a sputterer with a ⅝ inch diameter and a 150 Å thickness, gold dots were deposited onto the top charge transport layer of the photoconductors in the above Comparative Example 1 and Example I. The photoconductors were dark rested (in the absence of light) for at least two days at 22° C. and 50 percent RH to allow relaxation of the surfaces.

Subsequently, the above electroded photoconductor devices (gold dots on charge transport layer surfaces) were then cycled in a test fixture that injected positive charges through the gold dots with the methodology described above. The change in surface potential was then determined for injected charges of 27 $nC/cm^2$. This value was selected to be larger than typically expected in the above xerographic print engine to generate strong signals. Finally, the changes in the surface potentials were translated into ghost rankings by the aforementioned calibration curves. This method was repeated four times for each photoconductor, and then the averages were calculated. Typical standard deviation of the mean tested on numerous devices was about 0.35.

The ghosting ratings are reported in Table 1 that follows. The Example I photoconductor exhibited an about 50 percent lower ghosting than the Comparative Example 1 photoconductor. Thus, the incorporation of the vulcanized fatty ester into the photogenerating layer reduced ghosting.

TABLE 1

| | Ghosting Grade |
|---|---|
| Comparative Example 1 | 7.8 |
| Example I | 4.2 |

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor comprising a supporting substrate, a photogenerating layer, and at least one charge transport layer, and wherein said photogenerating layer includes a vulcanized fatty ester containing from about 5 weight percent to about 40 weight percent of sulfur, and which vulcanized fatty ester is selected from the group consisting of sulfurized corn oil, sulfurized canola oil, sulfurized cottonseed oil, sulfurized grapeseed oil, sulfurized olive oil, sulfurized palm oil, sulfurized peanut oil, sulfurized coconut oil, sulfurized rapeseed oil, sulfurized sesame seed oil, sulfurized soybean oil, sulfurized sunflower seed oil, sulfurized fish oil, and mixtures thereof, wherein said at least one charge transport layer is comprised of a top charge transport layer and a bottom charge transport layer, and wherein said top charge transport layer is in contact with said bottom charge transport layer and said bottom charge transport layer is in contact with said photogenerating layer.

2. A photoconductor in accordance with claim 1 wherein said vulcanized fatty ester is present in said photogenerating layer in an amount of from about 0.1 to about 30 weight percent.

3. A photoconductor in accordance with claim 1 wherein said vulcanized fatty ester is present in said photogenerating layer in an amount of from about 1 to about 20 weight percent and wherein said vulcanized fatty ester contains from about 10 to about 30 weight percent of sulfur.

4. A photoconductor in accordance with claim 1 wherein said vulcanized fatty ester is present in said photogenerating layer in an amount of from about 3 to about 10 weight percent, and wherein said vulcanized fatty ester contains from 10 to about 26 weight percent of sulfur.

5. A photoconductor in accordance with claim 1 wherein said sulfur source is selected from the group consisting of elemental sulfur, sulfur monochloride, sulfur dichloride, sodium sulfide, and sodium polysulfide.

6. A photoconductor in accordance with claim 1 wherein said vulcanized fatty ester is selected from the group consisting of sulfurized corn oil, sulfurized canola oil, sulfurized cottonseed oil, sulfurized grapeseed oil, sulfurized olive oil, and sulfurized palm oil.

7. A photoconductor in accordance with claim 1 wherein said photogenerating layer is comprised of at least one photogenerating pigment, a polymer, and said vulcanized fatty ester present in an amount of from about 1 to about 8 weight percent.

8. A photoconductor in accordance with claim 1 wherein said charge transport layer is comprised of

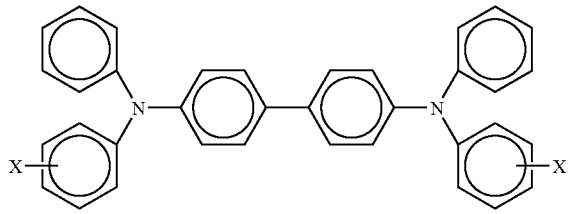

wherein X is selected from the group consisting of alkyl, alkoxy, aryl, and halogen, and mixtures thereof, and wherein at least one charge transport layer is from 1 to about 4.

9. A photoconductor in accordance with claim 8 wherein said alkyl and said alkoxy each contains from about 1 to about 12 carbon atoms, and said aryl contains from about 6 to about 36 carbon atoms; and wherein said vulcanized fatty ester is present in an amount of from about 1 to about 5 weight percent.

10. A photoconductor in accordance with claim 8 wherein said aryl amine is N,N'-diphenyl-N,N-bis(3-methylphenyl)-1,1-biphenyl-4,4'-diamine.

11. A photoconductor in accordance with claim 1 wherein said charge transport layer is comprised of

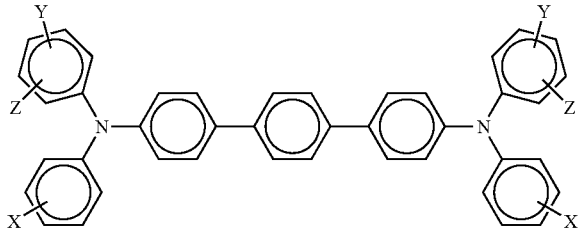

wherein X, Y, and Z are independently selected from the group consisting of alkyl, alkoxy, aryl, and halogen, and mixtures thereof.

12. A photoconductor in accordance with claim 1 wherein said bottom or said top charge transport layer includes a component selected from at least one of the group consisting of N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N-bis(3-methylphenyl)-1,1'-biphenyl-4,4'-diamine, and N,N'-diphenyl-N,N'-bis(3-chlorophenyl)-[p-terphenyl]-4,4'-diamine; and said vulcanized fatty ester is present in an amount of from about 1 to about 10 weight percent.

13. A photoconductor in accordance with claim 1 further including in at least one of said charge transport layers an antioxidant comprised of a hindered phenolic, a hindered amine, and mixtures thereof.

14. A photoconductor in accordance with claim 1 wherein said photogenerating layer is comprised of an at least one photogenerating pigment.

15. A photoconductor in accordance with claim 14 wherein said photogenerating pigment is comprised of at least one of a titanyl phthalocyanine, a hydroxygallium phthalocyanine, a halogallium phthalocyanine, a perylene, or mixtures thereof.

16. A photoconductor in accordance with claim 14 wherein said photogenerating pigment is comprised of a metal phthalocyanine, a metal free phthalocyanine, or mixtures thereof.

17. A photoconductor in accordance with claim 14 wherein said photogenerating pigment is comprised of a hydroxygallium phthalocyanine.

18. A photoconductor in accordance with claim 1 further including a hole blocking layer, and an adhesive layer, and wherein said vulcanized fatty ester is present in an amount of from about 2 to about 10 weight percent.

19. A photoconductor consisting essentially of a supporting substrate, a vulcanized fatty ester containing photogenerating layer, and a charge transport layer, and wherein said photogenerating layer comprises a photogenerating component and said vulcanized fatty ester contains from about 5 weight percent to about 40 weight percent of sulfur, and which vulcanized fatty ester is selected from the group consisting of sulfurized corn oil, sulfurized canola oil, sulfurized cottonseed oil, sulfurized grapeseed oil, sulfurized olive oil, sulfurized palm oil, sulfurized peanut oil, sulfurized coconut oil, sulfurized rapeseed oil, sulfurized sesame seed oil, sulfurized soybean oil, sulfurized sunflower seed oil, sulfurized fish oil, and mixtures thereof wherein said at least one charge transport layer is comprised of a top charge transport layer and a bottom charge transport layer, and wherein said top charge transport layer is in contact with said bottom charge transport layer and said bottom charge transport layer is in contact with said photogenerating layer.

20. A photoconductor comprising a photogenerating layer, and at least one charge transport layer, and wherein said photogenerating layer is comprised of at least one photogenerating pigment and a vulcanized fatty ester, and wherein said vulcanized fatty ester is present in an amount of from about 1 to about 12 weight percent, and said at least one charge transport layer is 1, 2, or 3 layers, wherein said vulcanized fatty ester contains from about 10 weight percent to about 26 weight percent of sulfur, and which vulcanized fatty ester is selected from the group consisting of sulfurized corn oil, sulfurized canola oil, sulfurized cottonseed oil, sulfurized grapeseed oil, sulfurized olive oil, sulfurized palm oil, sulfurized peanut oil, sulfurized coconut oil, sulfurized rapeseed oil, sulfurized sesame seed oil, sulfurized soybean oil, sulfurized sunflower seed oil, sulfurized fish oil, and mixtures thereof wherein said at least one charge transport layer is comprised of a top charge transport layer and a bottom charge transport layer, and wherein said top charge transport layer is in contact with said bottom charge transport layer and said bottom charge transport layer is in contact with said photogenerating layer.

21. A photoconductor in accordance with claim 1 wherein said vulcanized fatty ester is sulfurized corn oil, sulfurized canola oil, sulfurized cottonseed oil, or sulfurized palm oil.

22. A photoconductor in accordance with claim 20 wherein said vulcanized fatty ester is sulfurized corn oil, sulfurized canola oil, sulfurized cottonseed oil, sulfurized olive oil, or sulfurized palm oil.

* * * * *